US006398433B1

(12) United States Patent
Kubota

(10) Patent No.: US 6,398,433 B1
(45) Date of Patent: Jun. 4, 2002

(54) PRINTING METHOD FOR BLOCK COPY FILM AND BLOCK COPY PRINTER

(75) Inventor: Yasuhiro Kubota, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/620,752

(22) Filed: Jul. 21, 2000

(30) Foreign Application Priority Data

Jul. 26, 1999 (JP) ..... 11-211000

(51) Int. Cl.[7] ..... B41J 2/315

(52) U.S. Cl. ..... 400/120.05; 400/120.06; 400/120.09; 347/180; 347/182; 347/188

(58) Field of Search ..... 400/120.05, 120.06, 400/120.07, 120.09, 120.14; 347/180, 181, 182, 183, 184, 188

(56) References Cited

FOREIGN PATENT DOCUMENTS

| | | | |
|---|---|---|---|
| JP | 63-122595 | * | 5/1988 |
| JP | 63-276565 | * | 11/1988 |
| JP | 3-45355 | * | 2/1991 |
| JP | 6-262807 | | 9/1994 |
| JP | 2608330 | | 2/1997 |

* cited by examiner

*Primary Examiner*—Andrew H. Hirshfeld
*Assistant Examiner*—Minh H. Chau
(74) *Attorney, Agent, or Firm*—Brinks Hofer Gilson & Lione

(57) ABSTRACT

There will be provided a printing method for block copy film and a block copy printer capable of adjusting printing density as occasion arises as well as making joints between print lines inconspicuous. A predetermined mount of conveyance of transparent resin film P will be set to 1/N (N is an integer of 2 or more) of a predetermined printing width, which is a line-up width of the exothermic elements, and printing at a predetermined printing width will be repeated after the transparent resin film P is conveyed in the predetermined amount of conveyance.

3 Claims, 3 Drawing Sheets

PRINTING METHOD FOR BLOCK COPY FILM AND BLOCK COPY PRINTER

BACKGROUND OF THE INVENTION

1. Technical Field of the Invention

The present invention relates to a printing method for block copy film and a block copy printer for preparing block copy film by performing monochrome print on transparent film.

2. Description of the Prior Art

As a conventional method for preparing block copy film, there has been adopted a method for printing desired monochrome printing information on transparent resin film as a printing medium in black ink using a normal heat transfer printer.

More specifically, the prior art, method in which a black ink ribbon and the transparent resin film are pinched between a thermal head mounted on a carriage of a heat transfer printer and a platen, the ink ribbon is unreeled while the thermal head is caused to reciprocate together with the carriage along the platen, and a plurality of exothermic elements formed on the thermal head are selectively electrically energized (for generating heat), based on desired monochrome printing information for recorded images, whereby black ink of the ink ribbon is partially transferred onto the transparent resin film for printing the desired recorded images and the like.

At that time, when printing of one print line is completed, there are repeatedly performed operations for conveying the transparent resin film by conveying means by the same length as the line-up length of the exothermic elements of the thermal head in a sub-scanning direction, and printing the next print line on a portion of the transparent resin film which is different from the portion printed until then, whereby the desired recorded images have been obtained as block copy film.

According to the aforesaid method, however, there have been clearances created in the joint portions between print lines, that is, between the lower end of a preceding print line and the upper end of the next print line, thereby generating white streaks under the conveying system of the transparent resin film in the sub-scanning direction. The trouble occurring between each print line is called "stitching" is particularly conspicuous in monochrome block copy film. This consequently becomes problem and is a factor in determining whether or not it can be used as block copy film.

Also, in the finish in which the transparent resin film is coated in a single-layer state with ink, it has not been suitable for use as block copy film because of thin printing density.

SUMMARY OF THE INVENTION

The present invention has been achieved in the light of such problems, and is aimed to provide a printing method for block copy film and a block copy printer capable of adjusting printing density as occasion arises as well as making joints between print lines inconspicuous.

In order to accomplish the aforesaid object, a printing method for block copy film according to the present invention is, when performing monochrome printing based on printing data by selectively causing exothermic elements lined up and formed on a recording head to generate heat while a carriage is being moved along a platen for transferring black ink mounted on the carriage onto transparent resin film, and thereafter by repeatedly conveying the transparent resin film in a sub-scanning direction of the carriage, to set a predetermined mount of conveyance of the transparent resin film to 1/N (N is an integer of 2 or more) of a predetermined printing width, which is a line-up width of the exothermic elements, and to repeatedly print at a predetermined printing width after the transparent resin film is conveyed in the predetermined amount of conveyance.

By setting the amount of conveyance to less than the printing width in this manner, the upper end of each print line can be always located within the immediately preceding print line, and the problem on the stitching can be resolved.

Another printing method for block copy film according to the present invention is, when performing monochrome printing based on printing data by selectively causing exothermic elements lined up and formed on a recording head to generate heat while a carriage is being moved along a platen for transferring black ink mounted on the carriage onto transparent resin film, and thereafter by repeatedly conveying the transparent resin film in a sub-scanning direction of the carriage, to set a predetermined amount of conveyance of the transparent resin film to 1/N (N is an integer of 2 or more) of a printing width, which is a line-up width of the exothermic elements, at the commencement of printing, to print at a width obtained by substituting M=1 in M/N (M is an integer of 1 or more, M<N) from the upper end of a predetermined printing width, and thereafter, repeatedly printing at a printing width obtained by adding 1 to the M of the immediately preceding printing width from the upper end until M=N is reached. Concerning print lines to follow, to repeatedly print at a predetermined printing width after the transparent resin film is conveyed at the predetermined amount of conveyance, and at the completion of printing, to print at a printing width obtained by setting M=N in the printing width from the lower end of the predetermined printing width and thereafter, repeatedly printing at a printing width obtained by deducting 1 from the M of the immediately preceding printing width from the lower end until M=1 is reached.

By adopting such structure, it is possible to obtain printing with uniform density by superimposing ink in N layers at any points within the printing area, and by setting the amount of conveyance to less than the printing width, the upper end of each print line is always located within the immediately preceding print line, whereby the problem of stitching can be resolved.

Further, a printing method for block copy film according to the present invention is characterized by the fact that, in a printing method for block copy film according to second means of the present invention, printing at the commencement and the completion of printing is performed respectively by either of the methods by control of repeating conveyance of a predetermined amount of the transparent resin film and selective heat generation of the exothermic elements, and control of repeating only selective heat generation of the exothermic elements without the transparent resin film being conveyed.

By adopting such structure, it is possible to superimpose the ink in N layers even at upper and lower end portions of a printing area, and to obtain printing at uniform density within the entire printing area.

A block copy printer according to the present invention is characterized by having: recording means having a carriage for reciprocating along a platen and a recording head which selectively causes exothermic elements lined up and formed to generate heat for transferring black ink mounted to the carriage onto transparent resin film; conveying means for conveying the transparent resin film in a sub-scanning direction of the carriage; and control means for determining a predetermined amount of conveyance of the transparent resin film to 1/N (N is an integer of 2 or more) of the printing width, which is a line-up width of the exothermic elements, based on the user's desired recording density, and controlling to print at the predetermined printing width after the transparent resin film is conveyed at the predetermined amount of conveyance.

By adopting such structure, it is possible to always locate the upper end of each print line within the immediately preceding print line, thus making it possible to resolve the problem of stitching.

The block copy printer according to the present invention is characterized by the fact that, in a block copy printer according to the fourth means of the present invention, the control means controls so as to superimpose printing in the same number of times on the entire printing area of the transparent resin film. Also, the block copy printer according to the present invention is characterized by the fact that, in a block copy printer according to the fifth means of the present invention, the control means controls driving of the recording means and the conveying means in such a manner that at the commencement of printing, the printer prints at a width obtained by substituting M=1 in M/N (M is an integer of 1 or more, M<N) from the upper end of the predetermined printing width, and thereafter, repeatedly prints at a printing width obtained by adding 1 to the aforesaid M of the immediately preceding printing width from the aforesaid upper end until M=N is reached, and at the completion of printing, prints at a printing width obtained by setting M=N in the aforesaid printing width from the lower end of the predetermined printing width and thereafter, repeatedly prints at the printing width obtained by deducting 1 from the aforesaid M of the immediately preceding printing width from the aforesaid lower end until M=1 is reached.

By adopting such structure, it is possible to obtain printing at uniform density by superimposing the same ink within the printing area.

DETAILED DESCRIPTION OF THE PREFERRED EMBODIMENTS

Figure 1:
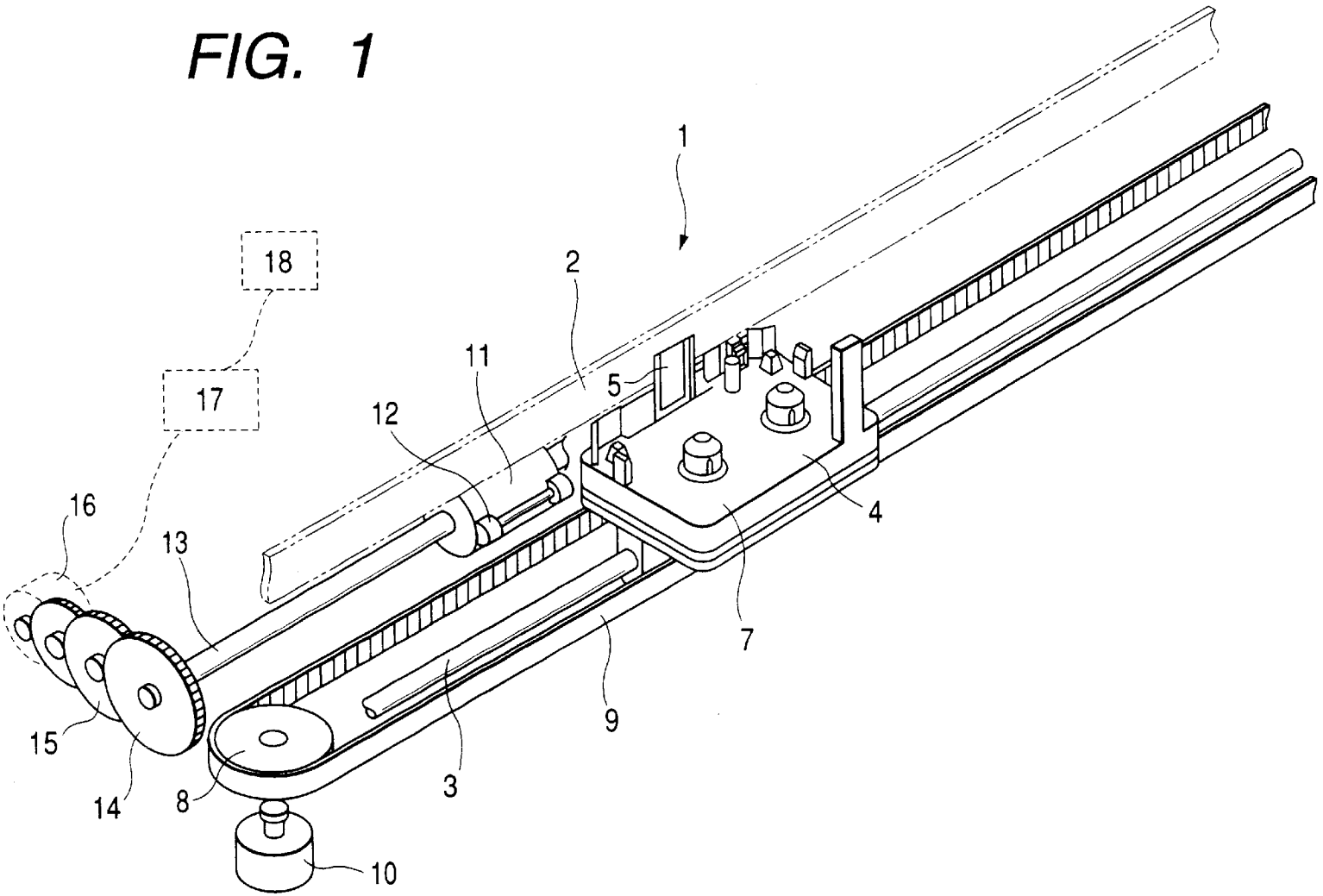
FIG. 1 is a perspective view showing major structure of a block copy printer according to an embodiment of the present invention.

Hereinafter, with reference to FIG. 1, a description will be made of an embodiment of the block copy printer 1, to which the printing method for block copy film according to the present invention has been applied.

A block copy printer 1 according to the present embodiment is a thermal printer such as a heat transfer printer, and has a platen 2, whose recording surface is placed substantially vertically at a desired position on a frame (not shown). Below the platen 2 on the front side, there is disposed a carriage shaft 3 parallel to this platen 2, and a carriage 4 is mounted to the carriage shaft 3 so as to be able to reciprocate along the platen 2. In a position of the carriage 4 opposite to the platen 2, there is disposed a thermal head 5 as a recording head, in which a plurality of exothermic elements are lined up and disposed. The upper surface of the carriage 4 is used as a cassette mounted surface 7 on which a ribbon cassette (not shown), in which an ink ribbon is wound and housed, is mounted.

In front of the platen 2, there is disposed a driving belt 9 wound around a pair of pulleys 8, and one end of the driving belt 9 is fixed to the carriage 4. One of the pulleys 8 is connected to a carriage motor 10, which is a stepping motor as a driving source in such a manner that the driving force of the carriage motor 10 is transmitted to the driving belt 9 through the pulleys 8.

Recording means for the block copy printer 1 according to the present embodiment is composed of the thermal head 5, the carriage 4, the carriage motor 10 and the like.

Below the platen 2, there is rotatably disposed a conveying roller 11 for conveying transparent resin film P as a recording medium between the platen 2 and the thermal head 5. Against the outer peripheral surface of the conveying roller 11, there is urged a pressing roller 12 for conveying the transparent resin film P while pinching it between the conveying roller 11 and the pressing roller 12. On one side (left side) of a rotating shaft 13 of the conveying roller 11, there is disposed a conveying roller gear 14, which is connected to a paper feed motor 16 as a driving source through a plurality of transmission gears 15.

Conveying means for the block copy printer 1 according to the present embodiment is composed of the conveying roller 11, the pressing roller 12, the paper feed motor 15 and the like.

The heat transfer printer 1 has a control unit 17 as control means for performing various control for the recording means, the conveying means and others on performing desired recording.

To the control unit 17, there is connected a density input switch 18 for inputting density of printing on the transparent resin film P. In the present embodiment, the control unit 17 is constructed so as to control the driving of the recording means and the conveying means in such a manner that it determines a predetermined amount of conveyance of the transparent resin film P to 1/N (N is an integer of 2 or more) of the printing width, which is a line-up width of the exothermic elements based on the user's desired recording density, controls so as to print at the predetermined printing width after the transparent resin film is conveyed at the predetermined amount of conveyance. At the commencement of printing, printing at a width obtained by substituting M=1 in M/N (M is an integer of 1 or more, M<N) from the upper end of the predetermined printing width, and thereafter, repeatedly printing at a printing width obtained by adding 1 to the aforesaid M of the immediately preceding printing width from the upper end until M=N is reached. At the completion of printing, at a printing width obtained by setting M=N in the aforesaid printing width from the lower end of the predetermined printing width, and thereafter, repeatedly prints at a printing width obtained by deducting 1 from the aforesaid M of the immediately preceding printing width from the lower end until M=1 is reached.

In other words, the control unit 17 is constructed such that, within a print area consisting of a plurality of print lines, the predetermined amount of conveyance of the transparent resin film P is set to 1/N of the printing width, which is a line-up width of the exothermic elements, whereby control is performed to convey the transparent resin film P in such a manner that the upper end of each print line is located at least within the immediately preceding print line, and control is also performed to print in such a manner that at least part of printing data within the print lines overlap. Further, the control unit 17 is constructed such that control is performed in such a manner that printing of the same number of times is superimposed on the entire printing area of the transparent resin film P.

Further, the control unit 17 according to the present embodiment is constructed such that at the commencement of the printing, there is performed such control that the transparent resin film is not conveyed, but only selective heat generation of the exothermic elements is repeated, and that at the completion of the printing, there is performed such control that conveyance of the predetermined amount of the transparent resin film and selective heat generation of the exothermic elements are repeated.

Subsequently, with reference to FIGS. 2 to 5, the description will be made of a printing method for block copy film using a block copy printer having this structure.

The control unit 17 determines a number of times of overlapped ink on the transparent resin film P on receipt of an user's input signal from the density input switch 18, that is, a number of times of overlapped printing. This number of times of overlapping is to serves as N, indicating the amount of conveyance. In this respect, on determining this value, in the present embodiment, the user's input numerical value will be judged directly as the aforesaid N, but it is also possible to arrange the structure to determine the numerical value of N by referring to a table indicating numbers of times of overlapped ink, inputted in a ROM or the like in the control unit 17 in advance, based on a numerical value indicating the user's desired printing density.

If the aforesaid N is assumed to be 3, the amount of conveyance of the transparent resin film P would be determined to be one third of the printing width on printing this block copy film. The aforesaid printing width will concretely be a line-up length of exothermic elements lined up and formed on the thermal head 5. Hereinafter, the description will be made of an example where the aforesaid N is set to 3.

Thus, first printing will be started on the basis of the desired recording data to be transmitted to the control unit 17. As regards the printing width at this time, printing is not performed using the full line-up length of exothermic elements lined up and formed on the thermal head 5, but printing at a width (range indicated by A in FIG. 2) of one third from the upper end of the print line concerned will be performed on the basis of the recording data.

Subsequently, the transparent resin film P will not be conveyed, but printing at a printing width obtained by adding 1 to the aforesaid M of the immediately preceding printing width, that is, printing at a printing width (range indicated by B in FIG. 2) of two thirds from the upper end of the print line concerned will be performed. This printing causes the range of the aforesaid A to be printed overlapped in two layers in ink as shown in FIG. 3.

Figure 4:
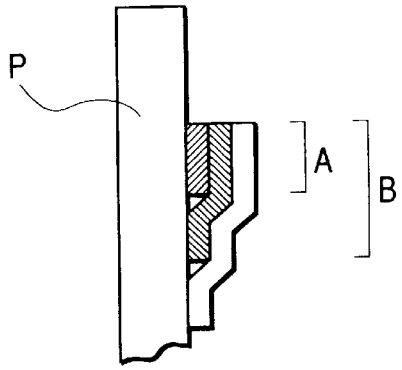
FIG. 4 is an explanatory view of a cross section showing a superimposed state of ink in a process next to the printing process shown in FIG. 3.

Printing at a printing width obtained by adding 1 to the aforesaid M of the immediately preceding printing width will be repeatedly performed in this manner until M=N is reached, and in the present embodiment until three thirds are reached. By thus performing repeatedly, on the portion indicated by A in FIG. 2, on which printing was first performed, the same recording data, on which black ink is overlapped in three layers, will be printed as shown in FIG. 4.

Figure 5:
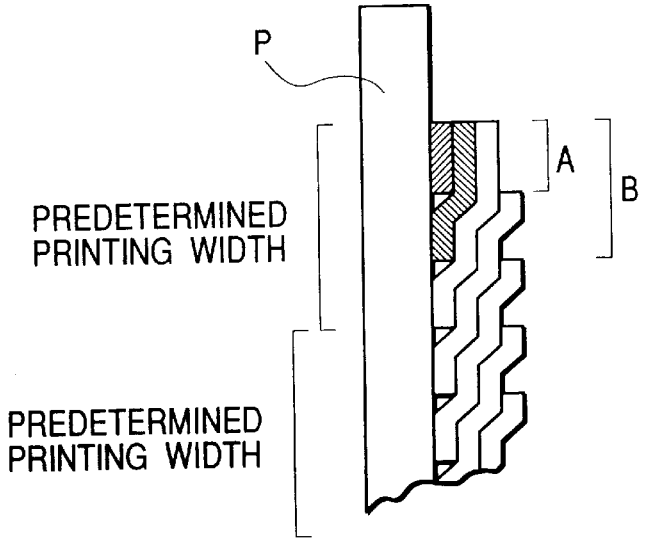
FIG. 5 is an explanatory view of a cross section showing a superimposed state of ink in the next process contiguous to the printing process shown in FIG. 4.

Printing of the print line to follow is obtained by repeatedly performing printing at a predetermined printing width, that is, printing at the full line-up length of exothermic elements lined up and formed on the thermal head 5 after the aforesaid predetermined amount of conveyance, that is, the transparent resin film P is conveyed at one third of the printing width as shown in FIG. 5.

Figure 6:
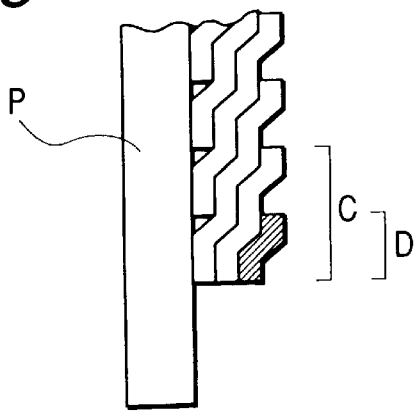
FIG. 6 is an explanatory view of a cross section showing a superimposed state of ink in a process at the completion of printing by using the printing method for the block copy film according to the present invention.

At the completion of the printing, printing is performed up to the lower end of the printing width concerned by printing at a predetermined printing width as shown in FIG. 6, thereafter, predetermined conveyance is performed, and printing at a printing width obtained by setting the aforesaid M to N−1 from the lower end of the print line concerned, that is, printing at a printing width (range indicated by C in FIG. 2) of two thirds from the lower end of the print line concerned will be performed this time because the printing width of the immediately preceding printing was three thirds. Subsequently, after predetermined conveyance, printing at a printing width obtained by deducting 1 from the aforesaid M of the immediately preceding printing width will be repeated until the aforesaid M=1 is reached. In other words, in the present embodiment, printing at a printing width (range indicated by D in FIG. 2) of one third from the lower end of the print line concerned will become final printing within the present printing area.

Figure 2:
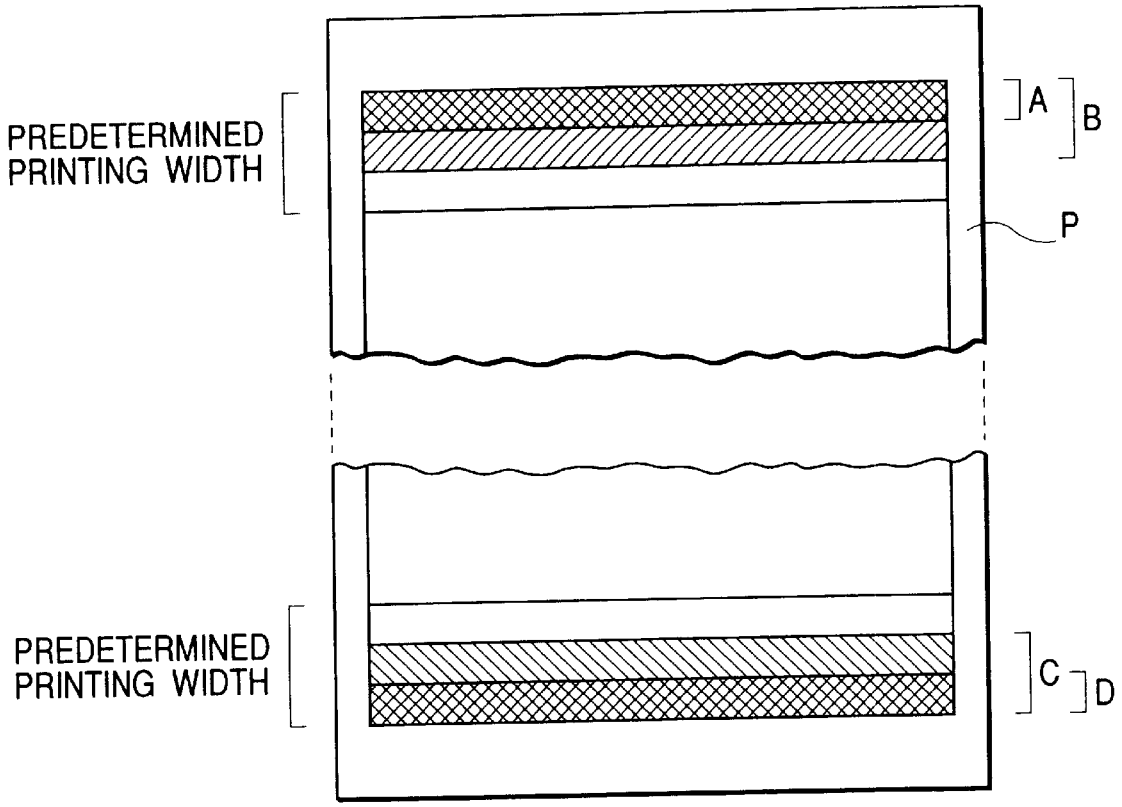
FIG. 2 is an explanatory view showing a recording range in a printing process of a printing method for a block copy film according to the present invention.
Figure 3:
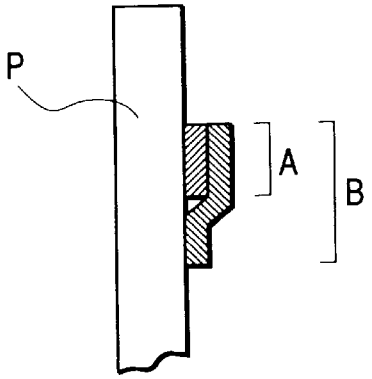
FIG. 3 is an explanatory view of a cross section showing a superimposed state of ink in a process at the commencement of printing by using the printing method for the block copy film according to the present invention.

By controlling the conveyance and printing of the transparent resin film P in this manner, on portions indicated by C and D in FIG. 2, the same recording data, on which black ink has been overlapped in three layers, will be printed as shown in FIG. 5.

On the block copy film thus printed, ink is capable of being overlapped in three layers at any points within the printing area, and the printing density becomes uniform within the printing area.

Moreover, if the user designates a number of times of overlapped ink, density of block copy film to be obtained can be made into desired density. For example, if information on the aforesaid N being set to 2 is obtained from the density input switch 18, the ink will be overlapped in two layers, and the printing will be denser than printing in a single layer, and thinner than printing with ink overlapped in three layers.

Since the upper end of each print line can be always located within the immediately preceding print line by setting the amount of conveyance to less than the printing width, it is possible to prevent white streaks from taking place at joints between print lines.

In this respect, the present invention is not limited to the aforesaid embodiments, but can be changed in various ways as occasion arises.

For example, in the present embodiment, the printing at the commencement of the printing has been controlled such that only selective heat generation of the exothermic elements is repeated without the transparent resin film being conveyed, but it is also possible to control such that there are repeated the conveyance of the predetermined amount of the transparent resin film and selective heat generation of the exothermic elements. In this case, heat will be generated from the lower end side of the line-up width of the exothermic elements. Also, in the printing at the completion of the printing, it is also possible to control such that the width of selective heat generation of the exothermic elements is made narrower in a lower end direction 1/N at a time for each printing without the transparent resin film being conveyed, instead of controlling so as to repeat the conveyance of the predetermined amount of the transparent resin film and the selective heat generation of the exothermic elements as in the case of the present embodiment.

As described above, according to the printing method for block copy film and the block copy printer of the present invention, it is possible to print at desired density by overlapping black ink in N layers, and to always locate the upper end of each print line within the immediately preceding print line by setting the amount of conveyance to less than the printing width. Therefore, this leads to the effect that white streaks can be prevented from taking place at joints between print lines.

What is claimed is:

1. A printing method for block copy film, comprising the steps of: when performing monochrome printing based on printing data by selectively causing exothermic elements lined up and formed on a recording head to generate heat while a carriage is being moved along a platen for transferring black ink mounted on the carriage onto transparent resin film, and thereafter by repeatedly conveying the transparent resin film in a sub-scanning direction of the carriage, setting a predetermined mount of conveyance of the transparent resin film to 1/N, N is an integer of 2 or more of a printing width, which is a line-up width of the exothermic elements, at the commencement of printing, printing at a width obtained by substituting M=1 in M/N, M is an integer of 1 or more, M<N from the upper end of a predetermined printing width, and thereafter, repeatedly printing at a printing width obtained by adding 1 to the M of the immediately preceding printing width from the upper end until M=N is reached, concerning print lines to follow, repeatedly printing at a predetermined printing width after the transparent resin film is conveyed in the predetermined amount of conveyance, and at the completion of printing, printing at a printing width obtained by setting M=N in the printing width from the lower end of the predetermined printing width and thereafter, repeatedly printing at a printing width obtained by deducting 1 from the M of the immediately preceding printing width from the lower end until M=1 is reached.

2. A printing method for block copy film according to claim 1, wherein printing at the commencement and completion of printing is performed respectively by either of methods using control of repeating conveyance of a predetermined amount of the transparent resin film and selective heat generation of the exothermic elements, and control of repeating only selective heat generation of the exothermic elements without the transparent resin film being conveyed.

3. A block copy printer, comprising:

recording means having a carriage for reciprocating along a platen and a recording head, which selectively causes exothermic elements lined up and formed to generate heat for transferring black ink mounted to the carriage onto transparent resin film;

conveying means for conveying the transparent resin film in a sub-scanning direction of the carriage;

control means for determining a predetermined amount of conveyance of the transparent resin film to 1/N, N is an integer of 2 or more of the printing width, which is a line-up width of the exothermic elements, based on the user's desired recording density, and printing at a predetermined printing width after the transparent resin film is conveyed in the predetermined amount of conveyance;

the control means to ensure that the overlap printing is performed the same number of times on the entire printing area of the transparent resin film; and the control means to ensure that the driving of the recording means and the conveying means is performed in such a manner that, at the commencement of printing, the printer prints at a width obtained by substituting M=1 in M/N, M is an integer of 1 or more, M<N from the upper end of the predetermined printing width, and thereafter, repeatedly prints at a printing width obtained by adding 1 to the M of the immediately preceding printing width from the upper end until M=N is reached and at the completion of printing, prints at a printing width obtained by setting M=N in the printing width from the lower end of the predetermined printing width and thereafter, repeatedly prints at a printing width obtained by deducting 1 from the M of the immediately preceding printing width from the lower end until M=1 is reached.

* * * * *